United States Patent [19]

Eheim et al.

[11] 4,318,382

[45] Mar. 9, 1982

[54] FUEL INJECTION PUMP

[75] Inventors: Franz Eheim, Stuttgart; Karl Konrath, Ludwigsburg; Manfred Schwarz, Gerlingen; Otmar Weiss, Stuttgart, all of Fed. Rep. of Germany

[73] Assignee: Robert Bosch GmbH, Stuttgart, Fed. Rep. of Germany

[21] Appl. No.: 90,219

[22] Filed: Nov. 1, 1979

Related U.S. Application Data

[63] Continuation of Ser. No. 832,703, Sep. 12, 1977, abandoned.

[30] Foreign Application Priority Data

Sep. 15, 1976 [DE] Fed. Rep. of Germany ..... 2641445

[51] Int. Cl.[3] ..... F02D 1/16

[52] U.S. Cl. ..... 123/502; 123/179 L

[58] Field of Search ..... 123/179 L, 500, 501, 123/502

[56] References Cited

U.S. PATENT DOCUMENTS

| | | | |
|---|---|---|---|
| 2,815,741 | 12/1957 | Fancher et al. | 123/502 |
| 2,894,499 | 7/1959 | Dermond | 123/179 L |
| 2,999,487 | 9/1961 | Stier et al. | 123/502 |
| 3,640,259 | 2/1972 | Garcea | 123/179 L |
| 3,742,925 | 7/1973 | Gordon, Jr. et al. | 123/502 |
| 3,815,564 | 6/1974 | Suda et al. | 123/502 |
| 3,943,902 | 3/1976 | Skinner | 123/139 AQ |
| 4,050,433 | 9/1977 | Tokashiki | 123/139 AQ |
| 4,122,813 | 10/1978 | Barnert et al. | 123/502 |
| 4,214,564 | 7/1980 | Skinner | 123/179 L |

FOREIGN PATENT DOCUMENTS

| | | | |
|---|---|---|---|
| 529671 | 11/1940 | United Kingdom | 123/139 ST |
| 804587 | 11/1958 | United Kingdom | 123/139 ST |
| 1342711 | 1/1974 | United Kingdom | 123/179 L |

*Primary Examiner*—Charles J. Myhre
*Assistant Examiner*—Andrew M. Dolinar
*Attorney, Agent, or Firm*—Edwin E. Greigg

[57] ABSTRACT

A fuel injection pump in which the beginning of the fuel injection is set to "early" during the warming-up of the engine by means of an adjustable piston. The adjustment occurs by shifting the adjustable piston by a control member acting through an adjusting member.

4 Claims, 8 Drawing Figures

FUEL INJECTION PUMP

This is a continuation, of application Ser. No. 832,703, filed Sept. 12, 1977, abandoned.

BACKGROUND OF THE INVENTION

The invention relates to a fuel injection pump with a cam drive which operates the fuel supply stroke of at least one pump piston. The pump includes a housing within which a part of the cam drive is mounted. The cam drive also has a revolving part, and the cam part within the housing is adjustable relative to the revolving part for the purpose of adjusting the initial point of the fuel injection by means of an adjusting piston which is acted upon with an rpm-dependent pressure, and which is movable against a reset force.

In a known fuel injection pump without a hydraulic initial point of injection the possibility exists of manually adjusting the injection point to "early". In the lower load and rpm range this fuel injection pump has no automatic injection point adjustment, so that this arbitrary change occurs in the range that is not covered by the automatic adjustment. In the higher load and rpm ranges the adjustment occurs mostly dependent on the load, since a linkage that is hinged on the arbitrarily activated adjusting lever of the governor serves as the connecting member between the rpm governor and the injection adjuster. Aside from the fact that the beginning point of injection is here dependent on the load, this device is indeed adjustable to "early" in the lower rpm and load ranges, but is generally turned off. Precisely in this rpm range, however, the beginning point of injection has a decisive influence on characteristics of the combustion, such as noise, poisonous gases, and fuel consumption.

OBJECT AND SUMMARY OF THE INVENTION

It is a primary object of the invention to provide a fuel injection pump with an adjusting piston, the position of which is variable for controlling the injection timing, and in particular the start of injection.

Briefly the fuel injection pump according to the invention has the advantage, that in a primarily rpm-dependent controlled injection beginning adjustment, the beginning of the injection is also changed at lower rpm's, and this adjustment superimposes an early adjustment from the start until the engine is warm. The assignment of injection beginning control signal magnitudes and rpm governor control signal magnitudes remain completely preserved, so that a temporary optimalization is possible. A further advantage is the very simple type of superposition, which can lead from a simple arbitrary adjustment to a fully automated one. Thus it is possible to advance the level of automation by the use of modules, and thus with simple means a number of different models can be achieved, whereby the basic components, such as the shiftable stop, for example, are present in all of the adjusting devices.

The invention will be better understood as well as further objects and advantages thereof become more apparent from the ensuing detailed description taken in conjunction with the drawings.

BRIEF DESCRIPTION OF THE DRAWINGS

Several exemplary embodiments of the invention are shown in the drawing and are described in more detail in the following.

DESCRIPTION OF THE PREFERRED EMBODIMENTS

Turning now to the drawings, it is known that the injection of fuel in a diesel engine occurs when the engine piston is in the area of its top dead center OT. The moment of the beginning of the injection thereby lies anywhere from before to shortly after OT, depending on the rpm, and generally it is earlier at high rpm's than at lower rmp's. During the time used by the fuel between pump and nozzle, which remains constant for the most part, independent of the rpm, the beginning of the injection is delayed as the rpm increases because of the varying pump feeding speeds and the combustion in the engine. This change of the timing relationship is neutralized by the injection moment adjuster, for which purpose a majority of its work capability is used. The remaining work capability serves, however, depending on the demand from the combustion engine, to improve the fuel consumption, the performance, the motor noise, and/or the exhaust gases. As is known, the delay in combustion of a diesel engine is dependent on temperature, specifically: 1. the fuel temperature and 2. the temperature of the engine, especially the cylinder wall temperature, injection temperature, etc. To neutralize this delay in combustion in cold engines, it is advantageous to advance the beginning of the injection while operating at low rpm's. (In higher rpm ranges, blue smoke and noisy operation are less serious.) In warm engines, however, this would lead to a rough operation and in addition the engine would be noisy. To advance injection is also known to be favorable during starting in order to achieve a rapid start of the engine. A further characteristic of a cold engine is, that with an advanced injection, less blue smoke is produced than when the injection is retarded.

Figure 1:
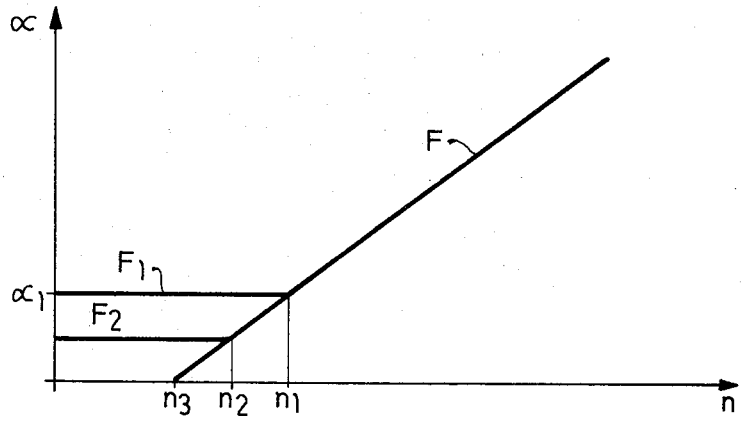
FIG. 1 is a diagram showing the amount of adjustment according to the rpm.

In the diagram shown in FIG. 1, the injection adjustment angle $\alpha$ is in the ordinate and the rpm n is in the abscissa. By injection adjustment angle is meant the relative rotation between the drive shaft and the piston drive of the injection pump, as described below in more detail. The rpm n is the pump rpm, i.e., the proportional engine rpm. The characteristic curve F corresponds to the injection adjustment during normal operational temperature. According to this characteristic curve F each rpm n corresponds to a certain adjustment angle. The higher the rpm n, the greater is the adjustment angle and the earlier the injection will begin. Also, according to the present invention, when starting the engine, particularly during lower rpm's and also when the engine is cold, an adjustment angle of $\alpha_1$ is set, in order to satisfy the above requirements. Not until the rpm climbs above an rpm $n_1$ does a further adjustment of $\alpha$ occur to create an "early" actuation. Actually $n_1$ can be as high as half of the maximum rpm. As long as the rpm's are smaller than $n_1$, a minimum advanced setting is maintained according to the characteristic curve $F_1$. As soon, then, as the engine is warm, the curve $F_1$ becomes ineffective, and the adjustment, even at rpm's that are smaller than $n_1$, occurs according to the characteristic curve F.

Figure 2:
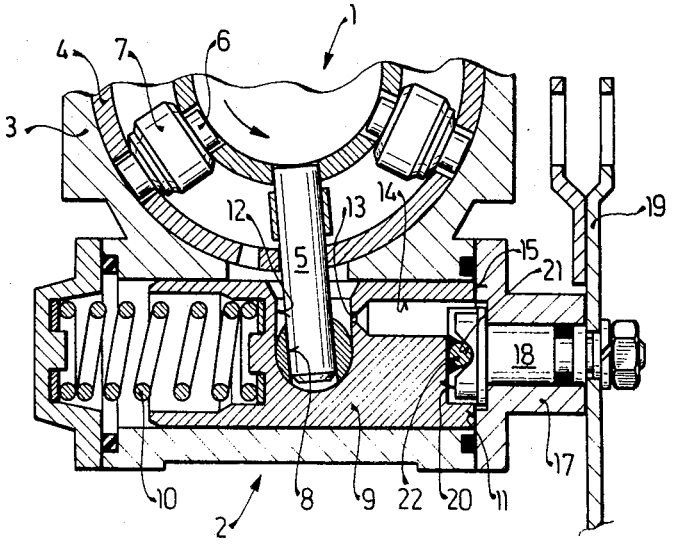
FIGS. 2, 3, and 4 show a cam dependent adjustment of the stop.

As shown in FIG. 2, an adjustment in a cam drive apparatus 1 of an injection pump not shown in greater detail, occurs by means of an injection adjuster 2. The selected examples concern distributing injection pumps, in which for the most part two types of cam drive devices are used. In the first type the rollers are connected with the pump piston and the cams are arranged on a ring which is guided by the housing. In the other type, as it was chosen here as an example, the rollers are situated on the ring guided by the housing, and the cams are disposed on a cam disc with the pump piston. In each instance the pump piston is driven separately, while the pump rollers and cam work together, whereby depending on the type of drive of the housing-guided ring, the rollers or cams are rotatable relative to each other by means of the injection adjuster 2.

In a housing 3 of the fuel injection pump of the exemplary embodiment of FIG. 2, a roller ring is guided, which is connected with the injection adjuster 2 by an adjusting pin 5. On the roller ring 4 rollers 7 are supported on axles 6, and are shown in a plan view. These rollers cooperate with a front cam plate, which is connected with the pump and distributor piston but not shown. The pump piston and front cam plate thereby rotate in the direction shown by the arrow. The beginning of the feed by the pump piston will occur earlier, i.e., as soon as the roller ring 4 is rotated against the direction of rotation by only a few degrees of an angle. If the amount of injected fuel is determined not by the control of beginning of the fuel feed, but rather by the control of the ending of fuel feed, then this type of shifting also means a change in the beginning of the fuel injected into the engine.

The adjusting pin 5 of the cam drive device engages in a recess 8 of an adjustable piston 9, which can be pushed against the force of a return spring 10 by hydraulic pressure. The further the piston 9 is pushed against the spring 10, the earlier fuel injection will begin. In the shown output position the piston 9 is arranged in abutment against a stop 11. The hydraulic pressure which serves the positioning function is produced in a known manner by a fuel feed supply pump, not shown, which, preferably is integrated into the housing 3 of the fuel injection pump and which is driven with its rpm. The output pressure of the fuel feed pump is controlled by a pressure control valve, so that it changes proportionally to the rpm, that is, it increases as the rpm goes up and decreases as the rpm goes down.

In the exemplary embodiment, the fuel feed pump feeds fuel into the housing 3, whereby fuel serves as the pumping medium. The fuel arrives in the pressure chamber or pumping space through corresponding supply bores not shown. In addition, fuel flows into a blind bore 12 situated in the adjustable piston 9, into which the adjusting pin 5 also projects. The fuel then flows through a throttling bore 13 and through a bore 14 to the front side 15 of the adjustable piston 9. With a sufficiently high feed pressure, the adjustable piston 9 is then pushed against the force of the spring 10 so that the beginning of the fuel injection can be advanced, as described earlier herein.

In order to achieve the above mentioned adjustment from the time of starting the engine until it is warm (FIG. 1), the adjusting piston 9 is mechanically shifted to create an "early" actuation by a stop. This stop can be formed in different ways, as shown in the respective embodiments.

In the embodiment shown in FIG. 2, the housing 3 is provided with a cover 17 in which a pivot bolt 18 is arranged on the same axis with the adjusting piston 9. The pivot bolt 18 is rotated by an adjusting lever 19, and includes at its free end a depression 21 that is arranged to cooperate with the projection 22 that is affixed to piston 9. The projection 22, which is shown in cross section may comprise a roller or other suitable spherically shaped structure that is affixed rigidly to the piston 9.

As soon as any movement is imparted to the lever 19 to rotate the pivot bolt 18 the roller 22 is forced out of the camming groove 21 since the adjusting piston 9 can only be reciprocated. The camming groove 21 and the roller 22 thus lie at right angles to each other. In this manner the adjusting piston 9 is pushed to cause an "early" actuation. The adjusting piston 9 is later returned to its original position as shown in FIG. 2 thus, as explained hereinbefore, being determined by the oblique positions of the groove and roller, which serve as a stop. A further adjustment of the piston 9 to achieve an "early" actuation will not occur because of the hydraulic pressure until such time as the rpm has reached the level $n_1$ shown in FIG. 1.

The operation of the lever 19, which serves as the adjusting member, can be done manually, but can also proceed automatically be means of a control member, as described herein below.

Figure 3:
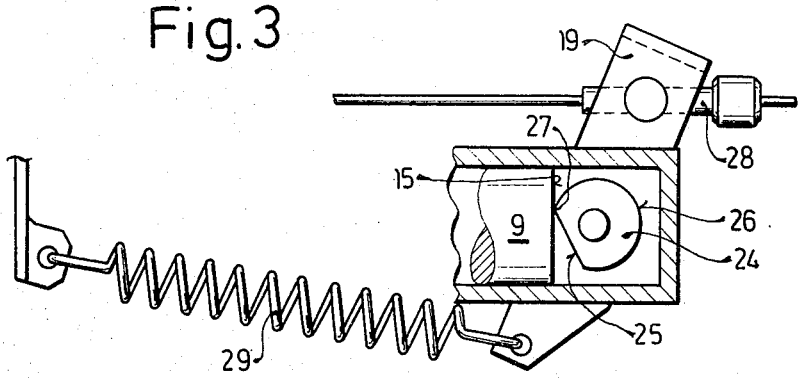

The exemplary embodiment shown in FIG. 3 shows that the shaft 24 has a flat section 25 in its generally circular perimetral outer surface 26. Depending on the rotational setting of shaft 24, the front face 15 either lies on the circular circumference thereof or in transition against the flat section of the shaft surface. As long as the piston 9 is in abutment with the flat section 25 fuel injection is set to begin as late as possible. However, if the shaft 24 is rotated by the lever 19, then the adjusting piston 9 is pushed to achieve an "early" actuation, until its front face 15 is tangential to the cylindrical perimeter surface 26 of the shaft 24. This latter position corresponds to a rotation angle of $\alpha_1$. In FIG. 3, an intermediate position between the flat area 25 and the perimetral surface 26 is shown, namely where the transition chamber 27 touched the front surface 15 of piston 9. This type of transition position corresponds to that of the transition curve $F_2$ in FIG. 1. Depending on the transition position, the adjusting piston 15 is accordingly pushed to an rpm $n_2$, that is, that at rpm's smaller than $n_2$, no adjustment of the injection adjuster occurs.

Also as shown in FIG. 3, Bowden wire 28 is arranged to engage the lever 19 and connected with the control member. The terminal end portion of the adjusting lever 19 is associated with a return spring 29 which attempts to turn the shaft 24 to its normal operating position. It is also to be understood that equivalent members 28 and 29 can, of course, also be arranged to engage the adjusting lever 19 in the exemplary embodiment shown in FIG. 2.

In the embodiments according to FIGS. 4–8, it is convenient to designate the starting-to-warm-up adjustment structure as a control unit.

Figure 4:
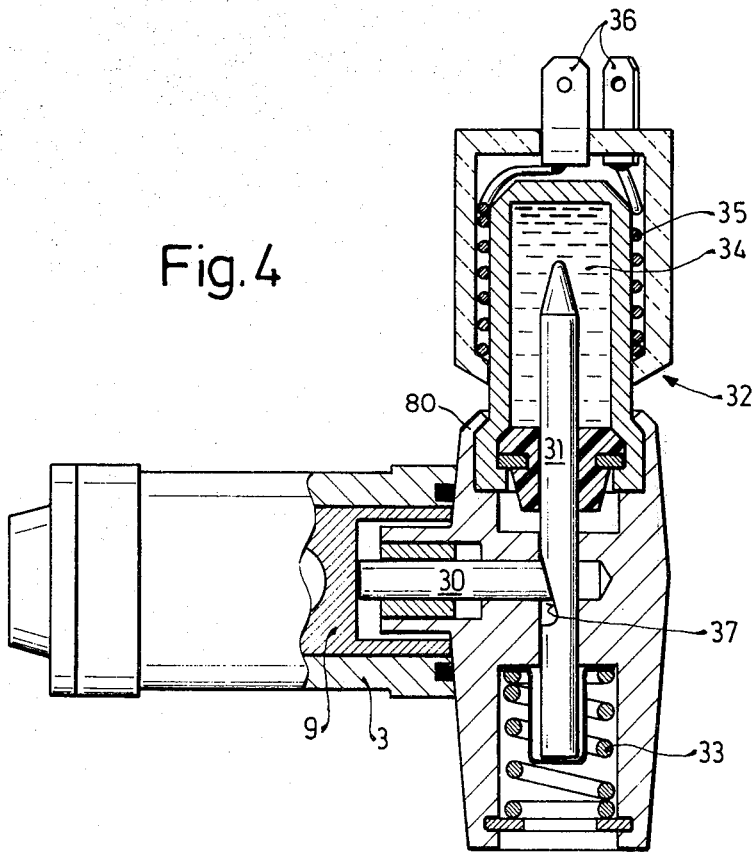

In the exemplary embodiment shown in FIG. 4 the stop adjustment is automated. The control unit according to FIG. 4 comprises an adjustable stop member, or bolt 30. The bolt 30 abuts piston 9 is activated by a movable bar 31, which serves as the adjusting member and is disposed perpendicularly to the injection-adjusting piston 9. The bar 31 is pushed by a thermostat comprising a compressible element 32 against the force of a return spring 33. The compressible element 32 operates in a known manner with a temperature-dependent change in volume of an elastic material such as wax that is disposed in a capsule 34. When the elastic material warms, it expands and has a tendency to push the element 31 slightly out of the capsule 34. The movement is largely proportional to the temperature. An electrical heating resistor 35 is arranged around the elastic element and includes connecting terminals. As soon as the driver of the motor vehicle "pre-heats" the engine for starting, the heating resistor 35 is turned on, so that the bar 31 pushes against the cup supported by the spring 33, and according to the contour of curve 37 the canted end wall of bolt 30 and thereby the adjusting piston 9 are pushed to achieve an "early" actuation. Once the motor vehicle is started, the heating resistor 35 is turned off, so that the elastic material can cool. Since the cooling, however, proceeds relatively slowly, some time passes before the bolt 30 again assumes the position shown in the drawing, at which time the adjusting piston 9 is again set to be actuated "late". This time interval is generally sufficient for the engine to warm up. The turning off of the heating coil 35 can, however, also be connected with a measuring member, which senses the warm condition of the engine. The reverse is also conceivable, that is, the elastic element could be heated by the coolant of the engine or even electrically during operation of the engine. In such a case, of course, the contour of the curve 37 would have the reverse pattern, that is the bolt 30 would have to be pushed toward an "early" actuation in the shown contracted position, and when heated, it would assume the illustrated extended position.

Both the bolt 30 and bar 31 are mounted to a mounting structure 80, which in turn is mounted to the housing 3.

Figure 5:
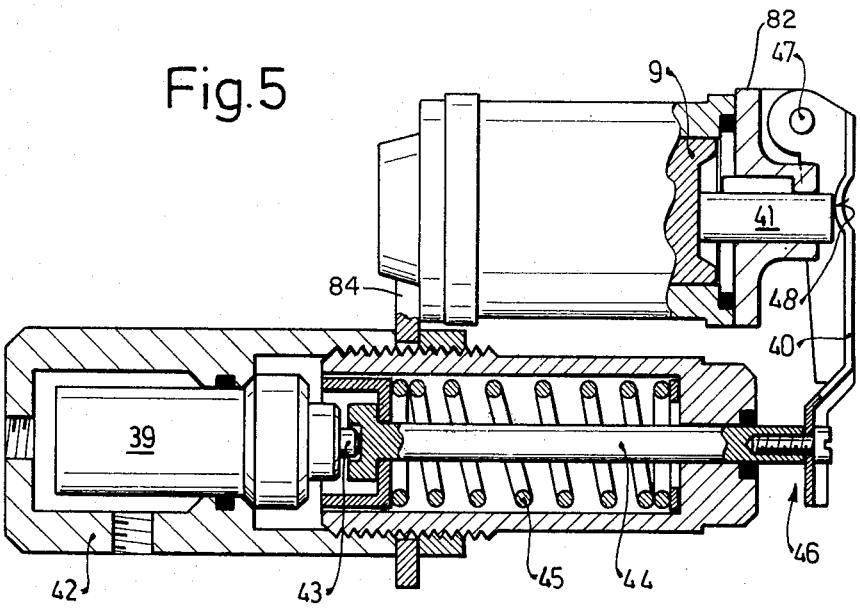
FIGS. 5, 6, and 7 show a direct adjustment of the stop by means of a thermostat.

In the embodiment of the invention shown in FIG. 5 the control unit comprises a thermostat which is embodied as an elastic element, also serving as the control member 39. Here the elastic element cooperates with a shank 44 that is affixed to a lever 40, which serves as the adjusting member, said adjusting member being adapted to contact a bolt 41 which serves as the adjustable stop member and which in turn pushes the adjusting piston 9. The elastic element 39 is mounted on a housing 42, through which the coolant of the engine is adapted to flow. The thermostat 39 has a terminal portion that cooperates with the shank 44 that is movably coupled with the lever 40 by a threaded bolt, as shown, at 46 against a return spring 45 arranged to urge the thermostat into an inactive condition. The lever 40 is mounted on pivotal axis 47 attached to the housing, and operates as a transfer lever by means of the detent 48, that is, a greater traveling of the rod 43 causes a relatively small travel of the bolt 41.

As shown, both the bolt 41 and the lever 40 are mounted to a mounting structure 82, which in turn is mounted to the housing 3. In addition, the thermostat is separately mounted by a mounting structure 84 to the housing 3.

Figure 6:
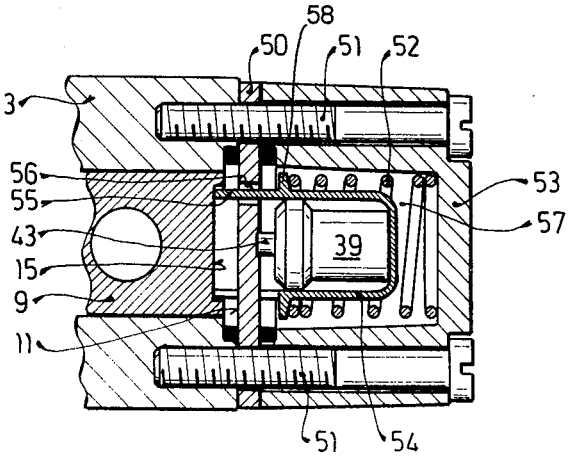

The control member 39 can, however, be arranged on the same axis as the adjusting piston 9 such as shown in FIG. 6. In this view the rod 43 of the thermostat 39 is supported on a plate 50 which is interposed between the housing 3 and a cap 53 which is firmly connected with said housing 3 by screws 51. The thermostat sits in a cup 54, which serves as the adjustable stop member, and as the rod 43 slides out of the thermostat 39, the entire thermostat and cap is urged against a spring 52 one portion of which is supported against the cap while the other end of the spring abuts an annular collar 58 provided on the cup 54. The cup 54 has extensions 55, which project through perforations 56 in the plate 50, and are arranged to operate directly on the adjusting piston 9. The chamber thus formed which contains the spring 52, is arranged to have engine coolant flow through it.

In this embodiment, the thermostat engages the adjustable stop member directly without the use of an adjusting member.

When the engine is cold, the rod 43 is contracted and the spring 52 pushes the thermostat 39 and the adjusting piston 9 by means of the extensions 55, into a position, which causes the injection to take place "early". As the temperature increases and the rod 43 begins to extend, the cup 54 is pushed against the force of the spring 52, so that the adjusting piston 9 moves to the right, as seen in the drawing to a "late" injection position. When the adjusting piston 9 moves up into contact with the opposite side of plate 50, i.e. to stop 11, the latest possible injection adjustment has then been achieved. However because the engine temperature usually increases beyond this point, for example, during a temporary overload, the thermostat 39 can be pushed farther, without effecting the beginning of injection, since the cup 54 is pushed farther against the spring 52. In this manner the extensions 55 are lifted completely away from the front surface 15 of the adjusting piston 9.

Figure 7:
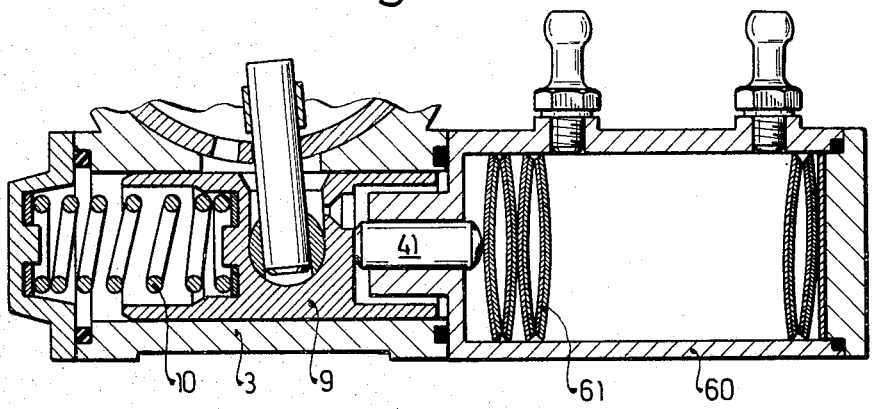

In the exemplary embodiment shown in FIG. 7, the control unit also engages the adjusting piston 9 on the same axis. The control unit comprises a stub bolt 41 which serves as the adjustable stop member and a thermostat which comprises a plurality of bimetallic discs 61, arranged in a cylinder 60, with these discs arranged to operate directly through a stub bolt 41 on the adjusting piston 9. The bimetallic discs 61 function in a known manner and are arched when cold and thus hold the adjusting piston 9 in a proper position for beginning an "early" injection. As soon as the engine warms up, the discs 61 are caused to flatten out and the adjusting piston 9 is pushed by the spring 10 into the position shown, which corresponds to the latest possible beginning of injection. An adjustment of the piston 9 begins even at the rpm $n_3$ (as shown in FIG. 1), which can be up to 50% smaller than the rpm $n_1$. In the automatically adjusted devices, the change of the rpm from $n_1$ to $n_3$, at which the beginning of injection is automatically adjusted, is made smooth.

In this embodiment also the thermostat engages the adjustable stop member directly without the use of an adjusting member.

Figure 8:
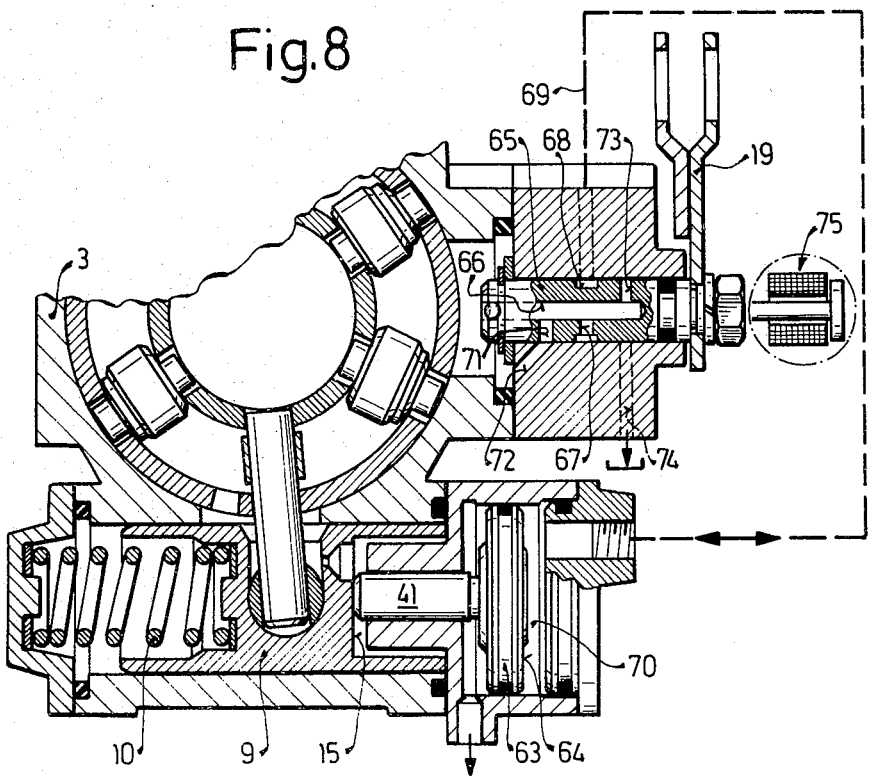
FIG. 8 shows an adjustment of the stop by means of an adjusting piston.

As described above, the rpm-dependent pressure of the supply pump prevails in the "pump intake space" or pressure chamber inside the housing 3. As shown in FIG. 8, this pressure is used according to a further exemplary embodiment, to adjust the stub bolt 41 that cooperates with the adjusting piston 9. For this purpose a servo piston 63 actuates the stub bolt 41. This servo piston has a surface area that is acted upon by the fuel itself and has a larger area than the surface area 15 of the adjusting piston 9 which is also acted upon by the fuel. The fuel flow to the front surface 64 is controlled by a rotary slide valve 65, which is pivoted by the lever 19.

The rotary slide valve 65 at the same time also serves as a stopper plug for the housing 3. A blind bore 66 is also provided in the rotary slide valve 65. From this bore 66 a radial bore 67 branches off and communicates with an annular groove 68 that is provided on the rotary slide valve 65. This annular groove 68 is connected by a channel 69 to a pressure chamber 70, which is defined by the front surface 64 of the servo piston 63. Further, the bore 66 in the rotary slide valve 65 also leads to another radial bore 71 that is arranged to communicate with an aperture of a bore 72 that is disposed in the interior of the housing 3 as shown. In addition, a third radial bore 73 branches off from the bore 66 with that aperture arranged to control the discharge bore 74 that is included in the housing and leads to the suction side of the supply pump. Depending on the rotational position of the rotary slide valve 65, the suction space of the fuel injection pump will either be connected with the pressure chamber 70 or this pressure chamber 70 will be connected with the suction side of the supply pump. Because of the relationship of the surfaces 15 and 64, even relatively small pressures are sufficient to push the servo piston 63 against the return spring 10 of the adjusting piston 9. Thus, as soon as starting rpm's are achieved and the rotary slide valve 65 opens the connection to the pressure chamber 70, the servo piston 63 is pushed into a position, at which the adjusting piston 9 causes the beginning of an "early" injection. After the engine is warm, the rotary slide valve 65 is adjusted by the control member, which was described herein but not shown in FIG. 8, and the pressure chamber 70 is connected with the suction side of the supply pump. In this manner the pressure chamber 70 is discharged and the spring 10 pushes the adjusting piston 9 into the position shown for the beginning of a "late" injection.

It is to be understood, of course, that the rotation of the slide valve 65 by means of the lever 19 also can be done manually or by other means, such as an electric positioning motor. A reversal of the hydraulic activation is also conceivable, whereby the stub bolt 41 can be pushed in the "late" direction by a servo piston 63, and the shift in the "early" direction is accomplished by a spring. In such a case, of course, this spring would have to be stronger than the return spring 10 of the adjusting piston 9. Instead of a rotary slide valve, a reciprocable slide valve that is equipped with suitably modified control bores could be used. Such a device could be activated, for example, by a reciprocable magnet 75. The slide valve 65 would then be adjusted against the fuel pressure that prevails in the housing 3, with such pressure arranged to serve as the return force.

In the embodiment according to FIG. 8, the stub bolt 41 and servo piston 63 serve as the adjustable stop member, and the slide valve 65 serves as the adjustable member.

If a cylinder which is adapted to receive bimetallic discs is used as the control member, which discs in contrast to the embodiment shown in FIG. 7, are arched when warm, then a deformation that exceeds the desired stroke can be absorbed by a spring arranged in the same axis.

The foregoing relates to preferred exemplary embodiments of the invention, it being understood that other embodiments and variants thereof are possible within the spirit and scope of the invention, the latter being defined by the appended claims.

What is claimed is:

1. In a fuel injection pump for an internal combustion engine including: a housing; at least one pump piston in said housing; a cam drive arranged in the housing to produce the fuel feeding stroke of the at least one pump piston; means producing a return force; and an adjustable piston connected to the return force producing means and to the cam drive, said cam drive including a rotatable part, with said cam drive being rotatable relative to the direction of rotation of the rotatable part for adjusting the timing of the beginning of the fuel injection by means of the adjustable piston which is acted upon by an rpm-dependent pressure against the return force of the return force producing means, the improvement comprising a control unit mounted to said housing for directly engaging the adjustable piston, said control unit comprising:

an adjustable stop member directly engageable with the adjustable piston;

a temperature sensitive device acting on the adjustable stop member;

further means for producing a return force; and a mounting structure in which the temperature sensitive device and the further means are mounted, said temperature sensitive device and said further means being operatively interposed between said adjustable stop member and said mounting structure, whereby from engine starting to engine warm-up, the temperature sensitive device varies the position of the adjustable stop member and consequently the adjustable piston in a direction to retard the beginning point of injection.

2. The fuel injection pump as defined in claim 1, said mounting structure further comprising:

a stop plate engageable with the adjustable piston to define an original position of the adjustable piston, said stop plate also serving as a support for the operation of the temperature sensitive device and the adjustable stop member.

3. The fuel injection pump as defined in claim 1, wherein the temperature sensitive device comprises a coolant heated thermostat.

4. The fuel injection pump as defined in claim 1, wherein the temperature sensitive device comprises an extensible thermostat.

* * * * *